US007748468B2

(12) United States Patent
Casciaro

(10) Patent No.: US 7,748,468 B2
(45) Date of Patent: Jul. 6, 2010

(54) SEALING DEVICES HAVING A METAL FOAM MATERIAL AND METHODS OF MANUFACTURING AND USING SAME

(75) Inventor: Dario Casciaro, Pescara (IT)

(73) Assignee: Baker Hughes Incorporated, Houston, TX (US)

( * ) Notice: Subject to any disclaimer, the term of this patent is extended or adjusted under 35 U.S.C. 154(b) by 55 days.

(21) Appl. No.: 12/082,312

(22) Filed: Apr. 10, 2008

(65) Prior Publication Data

US 2009/0255675 A1 Oct. 15, 2009

(51) Int. Cl.
*E21B 33/128* (2006.01)

(52) U.S. Cl. ..... 166/387; 166/192; 166/195

(58) Field of Classification Search ..... None
See application file for complete search history.

(56) References Cited

U.S. PATENT DOCUMENTS

| | | | | | |
|---|---|---|---|---|---|
| 3,952,656 | A * | 4/1976 | Fox et al. | ..... | 102/304 |
| 4,793,424 | A * | 12/1988 | Lim, Jr. | ..... | 175/228 |
| 5,936,913 | A * | 8/1999 | Gill et al. | ..... | 367/25 |
| 6,006,835 | A * | 12/1999 | Onan et al. | ..... | 166/295 |
| 6,626,243 | B1 * | 9/2003 | Go Boncan | ..... | 166/293 |

OTHER PUBLICATIONS

J.D. Burley, et al., Recent Developments in Packer Seal Systems for Sour Oil and Gas Wells, Oct. 9-12, 1977, pp. 1-8, SPE 6762, American Institute of Mining, Metallurgical, and Petroleum Engineers, Inc., U.S.A.

D.D. Onan, et al., Elastomeric Composites for Use in Well Cementing Operations, Oct. 3-6, 1993, pp. 593-608, SPE 26572, Society of Petroleum Engineers, Inc., U.S.A.

Thomas W. Ray, High Pressure/High Temperature (HP/HT) Seals for Oil and Gas Production, Feb. 17-19, 1998, pp. 603-614, SPE 39573, Society of Petroleum Engineers, Inc., U.S.A.

Gordon Mackenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

* cited by examiner

*Primary Examiner*—Zakiya W. Bates
(74) *Attorney, Agent, or Firm*—Greenberg Traurig LLP; Anthony F. Matheny

(57) ABSTRACT

Sealing devices such as packers comprise a metal foam material disposed on a surface. The metal foam material comprises an initial position comprising a plurality of pockets each having an initial volume and a compressed position in which at least one of the initial volumes of at least one of the plurality of pockets is reduced by compression of the metal foam material, thereby forming a seal. The seal may be formed directly between the metal foam material and a sealing surface such as an inner wall surface of a wellbore to divide an annulus of the wellbore. Alternatively, the seal may be at least partially formed between a sealing material disposed within one or more of the plurality of pockets that is extruded from at least one of the plurality of pockets during compression of the metal foam material.

22 Claims, 4 Drawing Sheets

SEALING DEVICES HAVING A METAL FOAM MATERIAL AND METHODS OF MANUFACTURING AND USING SAME

BACKGROUND

1. Field of Invention

The invention is directed to sealing devices for isolating an annulus of an oil or gas wellbore and, in particular, to sealing devices having a metal-foam material.

2. Description of Art

Packers for sealing wellbores are known in the art. For example, some packers include swellable materials encased within an expandable sealing element such as a rubber casing or balloon are known in the art. These types of packers expand and, thus, seal to the inner wall surface of a wellbore by contacting hydraulic fluid or other fluid with the swellable materials encased within the rubber casing so that the swellable materials absorb the fluid and expand. In one type of these packers, for example, hydraulic fluid is pumped down a string of tubing having the packer secured thereto. The hydraulic fluid travels down the bore of the string of tubing and through a port that is in fluid communication with an inner cavity of the rubber casing. Swellable materials disposed within the rubber casing are contacted by the hydraulic fluid. As a result, the swellable materials absorb the fluid and expand. As the swellable materials expand and hydraulic fluid is pumped into the rubber casing, the rubber casing expands to seal the wellbore. After expansion, hydraulic fluid pressure is decreased and the rubber casing remains is held in the expanded position solely by the swellable materials having absorbed the fluid.

Other packers are formed of an elastomeric material that is compressed or otherwise forced into the inner wall surface of the wellbore such as by expanding casing or axially compressing the elastomeric material that is disposed along an outer wall surface of the packer assembly.

SUMMARY OF INVENTION

Broadly, sealing devices such as packers include a sealing element that includes a metal foam material. The metal foam material may have a closed-cell structure or arrangement or an opened-cell structure or arrangement. The sealing element may be formed out of the metal foam material in its entirety. Alternatively, the sealing element may be formed of a metal foam material having a sealing material, such as an elastomeric, polymeric, or other material coated on the metal foam material, in the case of a closed-cell metal foam material, or disposed within the open cells, i.e., the interstitial spaces, of the opened-cell metal foam material. In still another embodiment, the metal foam material may be coated with another metal that has a lower melting point to facilitate bonding the metal foam material to a surface of the sealing device.

In one particular embodiment of the sealing element, the metal foam material is a closed-cell metal foam material comprising aluminum and having a sealing material coating. In another specific embodiment of the sealing element, the metal foam material is an opened-cell metal foam material comprising aluminum and having a sealing material disposed within the interstitial spaces of the opened-cell metal foam material.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
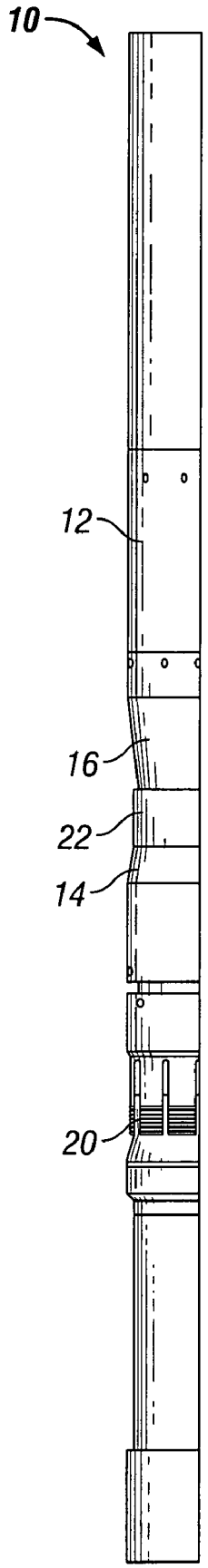
FIG. 1 is a partial side view of a sealing device showing a seal ring disposed on the outer surface of the downhole tool, the seal ring comprising a metal foam material.

Referring now to FIG. 1, a sealing device or downhole tool, such as a packer 10, includes a body or housing 12 and a sealing member or seal ring 22 disposed on the outer surface of housing 12 for sealing against a surrounding well casing (not shown). Housing 12 is generally cylindrical but may be any shape desired or necessary to form the downhole tool. An actuating member 14 is mounted to housing 12 for axial movement relative to housing 12. In this example, actuating member 14 engages a lower end of seal ring 22 for pushing seal ring 22 upward on a stationary cam surface 16 of housing 12 to cause seal ring 22 to expand radially into the set position. Cam surface 16 is preferably conical. Actuating member 14 may be an annular collet that is radially expandable, or it could be other configurations. In this embodiment, actuating member 14 is secured to a piston (not shown) supplied with hydraulic pressure for moving seal ring 22 relative to cam surface 16.

Tool 10 may be of a conventional design, and actuating member 14 may be moved by a variety of means other than hydraulic pressure, such as employing the weight of the running string (not shown) for tool 10, hydrostatic wellbore pressure, wireline movement, or explosives. Also, although seal ring 22 is shown moving upward onto stationary cam surface 16, the arrangement could be reversed, with seal ring 22 being moved downward. Further, seal ring 22 could be held axially stationary and cam surface 16 be moved relative to seal ring 22. For example, actuating member 14 may be held stationary while the running string and housing 12 move downward relative to seal ring 22, pushing seal ring 22 farther onto conical cam surface 16. Alternately, actuating member 14 may move upward relative to seal 22. Regardless of the arrangement, in these embodiments, seal ring 22 and cam surface 16 move axially relative to each other while being set to deform seal ring 22 radially outward to a larger diameter for engaging an inner wall surface of an outer tubular member (not shown) into which tool 10 is lowered. Outer tubular member may be a string of casing. As shown in FIG. 1, tool 10 in this example also has a set of slips 20 that expand outward and frictionally grip the inner wall surface of the outer tubular member.

Figure 2:
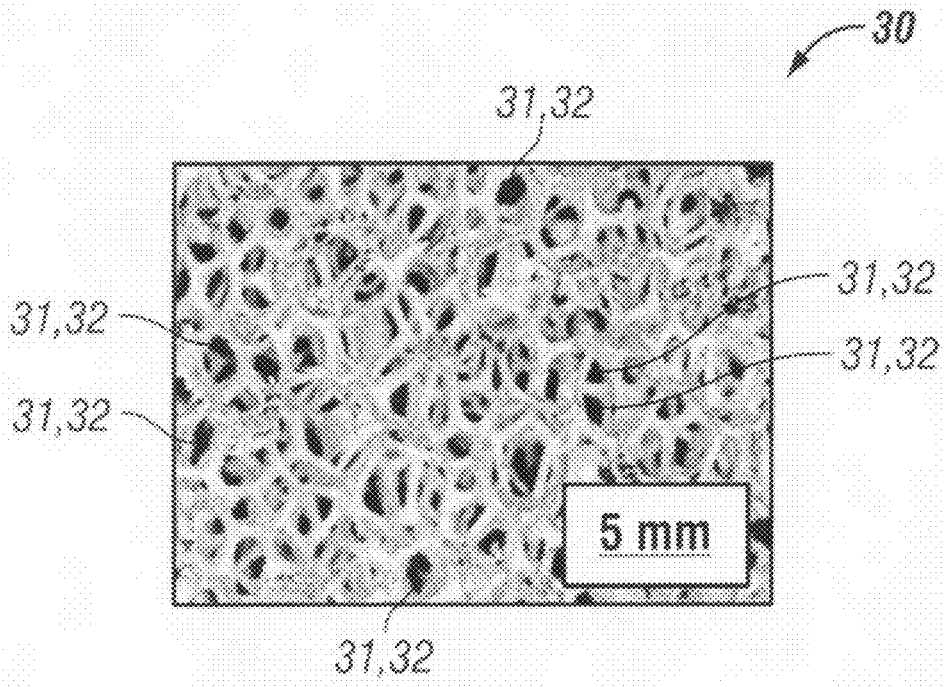
FIG. 2 is a microscopic view of a specific metal foam material of a sealing device disclosed herein.
Figure 3:
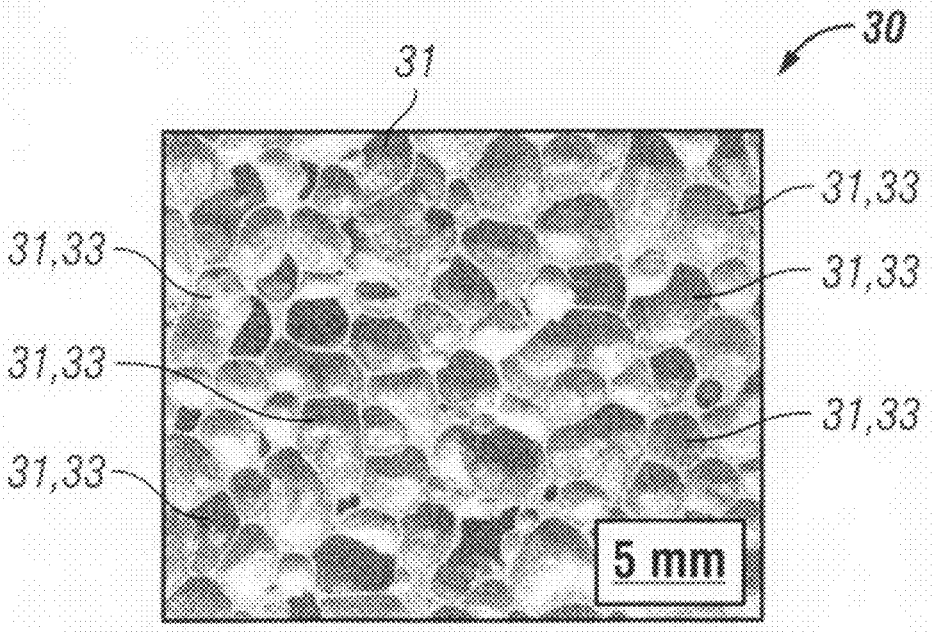
FIG. 3 is a microscopic view of another specific metal foam material of a sealing device disclosed herein.
Figure 4:
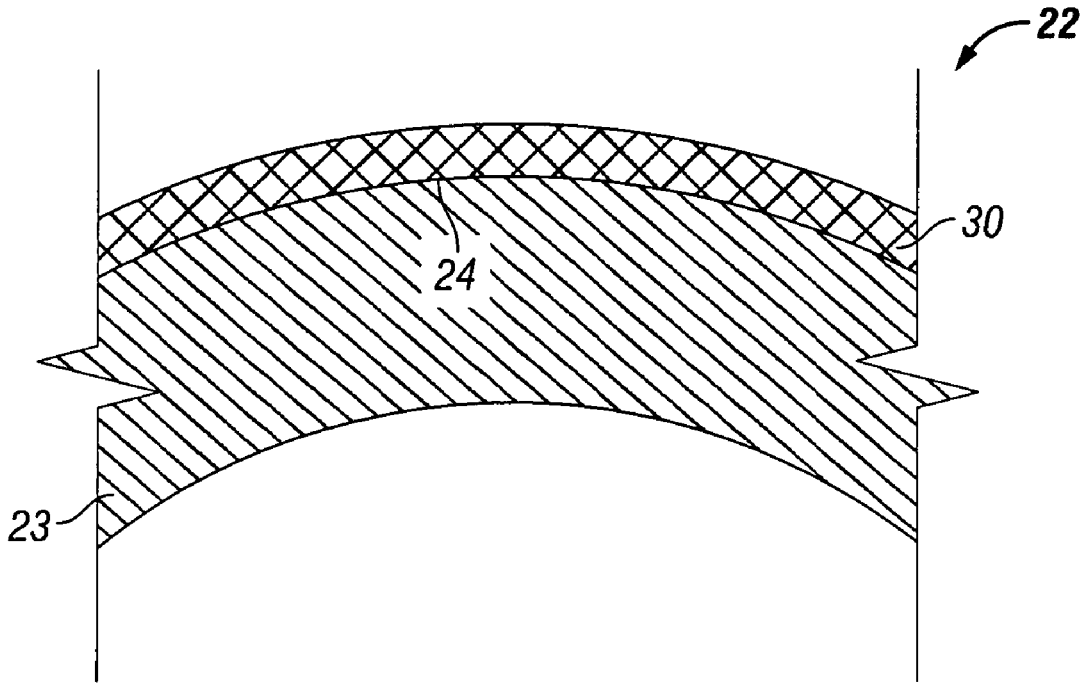
FIG. 4 is partial cross-sectional top view of one specific embodiment of a seal ring of the downhole tool of FIG. 1 showing a metal foam material disposed on a metal surface of the seal ring.

Referring now to FIGS. 2-4, seal ring 22 has an internal metal reinforcing element 23, thus providing metal surface 24. In one embodiment, reinforcing element 23 is formed of a carbon steel. Metal foam material 30 is disposed on metal surface 24 of reinforcing element 23 and may be bonded to, adhered to, or formed as a part of, metal surface 24 through any method or device known in the art. Metal foam material 30 may be an opened-cell metal foam material having a plurality of pockets 31 shown as interstitial spaces 32 (FIG. 2) or a closed-cell metal foam material having a plurality of pockets 31 shown as craters 33 (FIG. 3).

As used herein, the term "metal foam material" means a metallic cellular structure consisting of a solid metal containing a volume fraction of gas, e.g., air, filled pockets. The pockets can be sealed (closed-cell metal foam material such as shown in FIG. 3), or they can form an interconnected network (opened-cell metal foam material having interstitial spaces such as shown in FIG. 2). The size of the pockets, also referred to as "cell size" is usually between 1 mm and 8 mm. Metal foam materials 30 can be compressed by collapsing or compressing the pockets with the metallic cellular structure.

The metal foam materials can have a wide variety of porosity percentages, e.g., greater than 20%, greater than 40%, greater than 50%, greater than 60%, greater than 70%, greater than 80%, greater than 90%, or up to 95%. The term "porosity" refers to the volume of "non-metal," e.g., air, contained in the pockets in the metal foam material. Thus, the greater the porosity, the more compressible the metal foam material. The term "compressible" means the ability of the metal foam material's initial volume having an initial porosity (also referred to herein as the metal foam material's initial position) to be compressed or compacted into a smaller volume having a compressed porosity (also referred to herein as the metal foam material's compressed position). Although the compressed porosity can approach and possibly equal zero, it is to be understood that the compressed porosity can be greater than 0% provided is it is less than the initial porosity.

As mentioned above, one type of metal foam material is an opened-cell metal foam material. Suitable opened-cell metal foam materials may be commercially obtained from ERG Materials and Aerospace Corp. of Oakland, Calif., sold under the brand name Duocel®, Metal Foam Korea of Chungbuk, Korea, M. Pore GmbH of Dresden, Germany, Porvair Plc, Corp. of Norfolk, England, sold under the name Porvair®, Metafoam Technologies Inc. of Brossard, Quebec, Canada, Recemat International BV of The Netherlands sold under the brand name Recemat™, and Reade Metals & Minerals Corp., doing business as Reade Advanced Materials and/or Reade International, located in Providence, R.I., and Inco Specialty Products, sold under the brand name Incofoam®.

Another type of metal foam material is a closed-cell metal foam material. Suitable opened-cell metal foam materials may be commercially obtained from Cymet Corp. of Ontario, Canada, sold under the brand name Cymet®, and the Shinko Wire Company Ltd. of Amagasaki, Japan.

The metal foam materials described herein can be formed out of any metal material that is capable of being formed in either an opened-cell structure (or arrangement) or a closed cell structure (or arrangement). One suitable metal used to form metal foam material 30 includes aluminum due to its ability to resist high temperatures which allows it to provide a strong seal as well as be able to be bonded or adhered to softer metals having lower melting points which in turn are bonded to metal surface 24 (see discussion below regarding the embodiments of FIGS. 6-7). Other suitable metal foam materials comprise nickel, iron, steel, titanium, any alloy thereof, or any other metal or alloy desired.

In the embodiments in which metal foam material 30 is an opened-cell metal foam material (FIG. 2), a sealing material, not shown in FIG. 2 or 4, but discussed in greater detail below with respect to FIG. 5, may be disposed within the interstitial spaces 31 (FIG. 2) provided by the opened-cell metal foam material. In such an embodiment, the opened-cell metal foam material mechanically supports the sealing material to a microscopic and isotropic extent. Disposition of the sealing material within interstitial spaces 31 may be accomplished using any method or device know in the art. In one specific embodiment, the sealing material is disposed within interstitial spaces 31 by melting the sealing material and pouring the melted sealing material into interstitial spaces 31.

Figure 5:
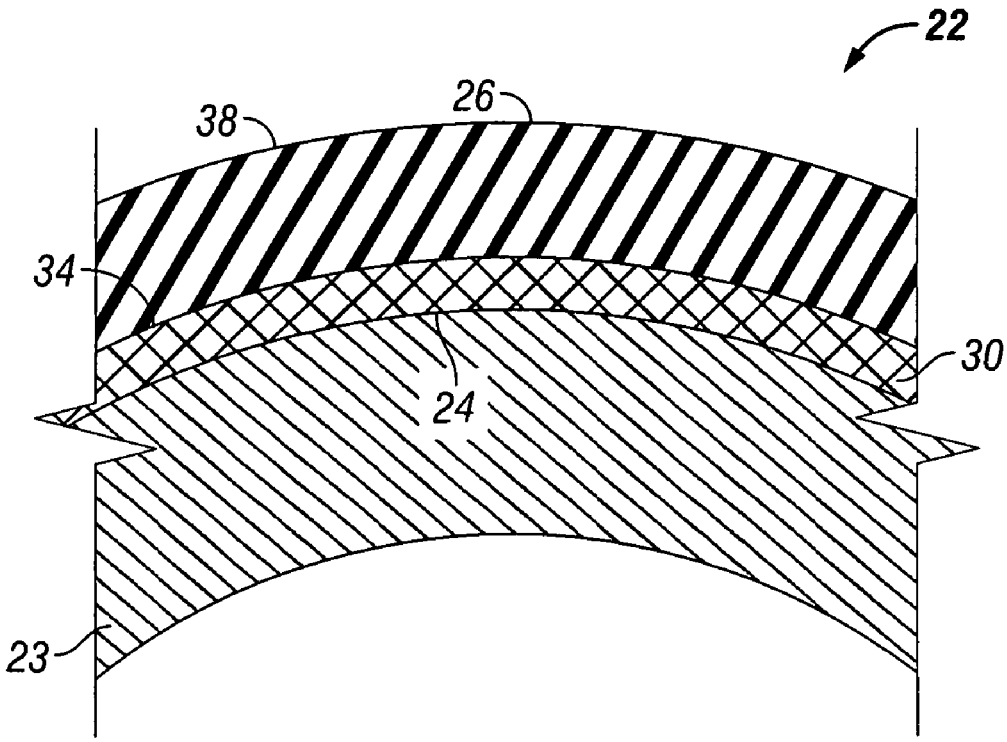
FIG. 5 is a partial cross-sectional top view of another specific embodiment of a seal ring of the downhole tool of FIG. 1 showing a metal foam material disposed between a sealing material and a metal surface of the seal ring.

In another embodiment shown in FIG. 5, reinforcing element 23 comprises metal foam material 30 disposed on metal surface 24 and sealing material 26 disposed on metal foam material 30. Sealing material 26 may be bonded or adhered to metal foam material 30 through any method or device known in the art, e.g., use of high-temperature adhesives or by melting sealing material 26 to the surface of metal foam material 30. Although not shown in FIG. 5, sealing material 26 may also be disposed between metal foam material 30 and metal surface 24 to further facilitate creation of a seal when metal foam material 30 is compressed.

In this specific embodiment, metal foam material 30 may be an opened-cell metal foam material (FIG. 2) or a closed-cell metal foam material (FIG. 3). In the embodiments in which metal foam material 30 is an opened-cell metal foam material (FIG. 2), sealing material 26 may be disposed within the interstitial spaces 31 (FIG. 2) provided by the opened-cell metal foam material (as discussed above with respect to the embodiment of FIG. 4), as well as extending outwardly from metal foam material surface 34 to provide sealing material surface 38 (as shown in FIG. 5). In the embodiments in which metal foam material 30 is a closed-cell metal foam material, sealing material 26 is disposed on the surface of metal foam material 30, including within each pocket or crater 33 (FIG. 3) on the surface of metal foam material 30 so that during compression, sealing material 26 microscopically reduces extrusion gaps to form a tight seal.

Sealing material 26, as well as the sealing material possibly disposed within interstitial spaces 31 as discussed above with respect to FIG. 4, may be any material known to persons of ordinary skill in the art. In the preferred embodiment, sealing material 26 is a resilient, elastomeric or polymeric material of a commercially available type that, in some applications, can withstand high temperatures that occur in some wells. For example, sealing material 26 may be a perfluoro elastomer, a styrene-butadiene copolymer, neoprene, nitrile rubber, butyl rubber, polysulfide rubber, cis-1,4-polyisoprene, ethylene-propylene terpolymers, EPDM rubber, silicone rubber, polyurethane rubber, or thermoplastic polyolefin rubbers. Preferably, the durometer hardness of sealing material 26 is in the range from about 60 to 100 Shore A and more particularly from 85 to 95 Shore A. In one embodiment, the durometer hardness is about 90 Shore A. Other suitable sealing materials 26 include Teflon® (polytetrafluroethylene or fluorinated ethylene-propylene) and polyether ether ketone. Sealing material 26 also could be nitrile rubber. Further, sealing material 26 may be any other thermoset material, thermoplastic material, or vulcanized material, provided such sealing materials are resilient and capable of facilitating creation of the desired seal.

Additionally, sealing material 26 may comprise a swellable material such that sealing material 26 expands when placed in contact with a fluid such as a hydrocarbon or water. Suitable swellable materials include cross-linked or partially cross-linked polyacrylamide, polyurethane, ethylene propylene, or other material capable of absorbing hydrocarbon or aqueous, or other fluids, and, thus, swelling to provide the desired seals. Inclusion of a swellable material, such as within interstitial spaces 32 or craters 33 facilitate creation of a seal by allowing the swellable material to expand and, thus, extrude out of, interstitial spaces 32 or craters 33. As a result, metal foam material 30 provides a mechanical support for the swellable material which can increase the sealing capabilities of the swellable material.

Figure 6:
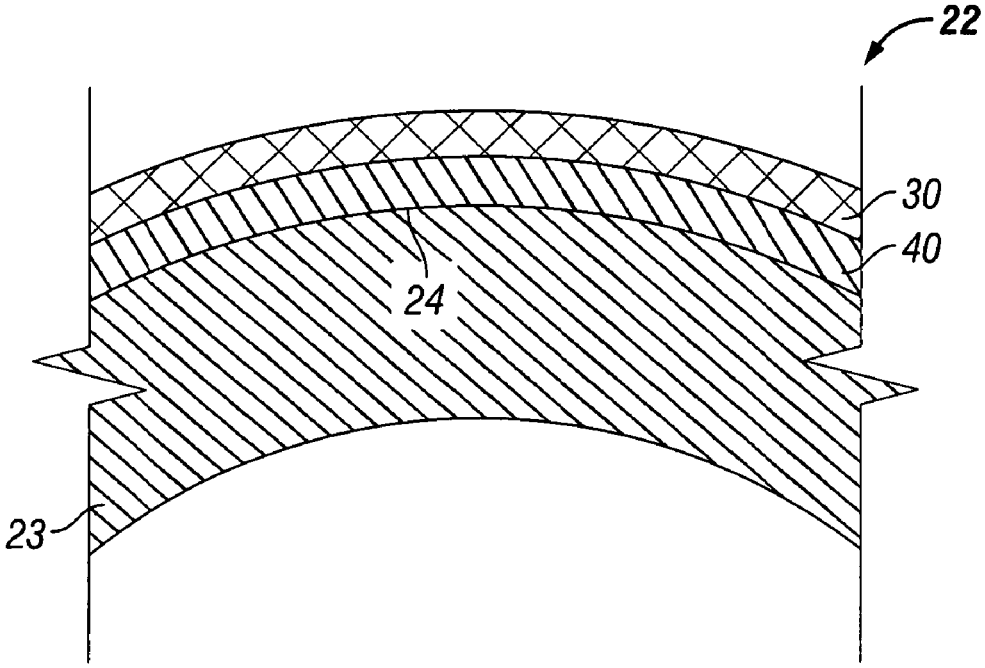
FIG. 6 is a partial cross-sectional top view of an additional specific embodiment of a seal ring of the downhole tool of FIG. 1 showing a metal foam material disposed on an adhesion metal that is disposed on a metal surface of the seal ring.

As illustrated in FIG. 6, in another particular embodiment, metal foam material 30 is disposed on one or more adhesion metals 40 to facilitate bonding metal foam material 30 to metal surface 24 of reinforcing element 23. Suitable adhesion metals 40 include any metal that has a melting point that is less than the melting point of metal foam material 30. Examples include, but are not limited to, lead, copper and gold, when metal foam material 30 comprises aluminum.

In the embodiment of FIG. 6, metal foam material 30 may be an opened-cell metal foam material (FIG. 2) or a closed-cell metal foam material (FIG. 3). Like the embodiment of FIG. 4, the embodiments in which metal foam material 30 is an opened-cell metal foam material (FIG. 2), a sealing material (not shown in FIG. 6) may be disposed within the interstitial spaces 31 (FIG. 2) provided by the opened-cell metal foam material.

Figure 7:
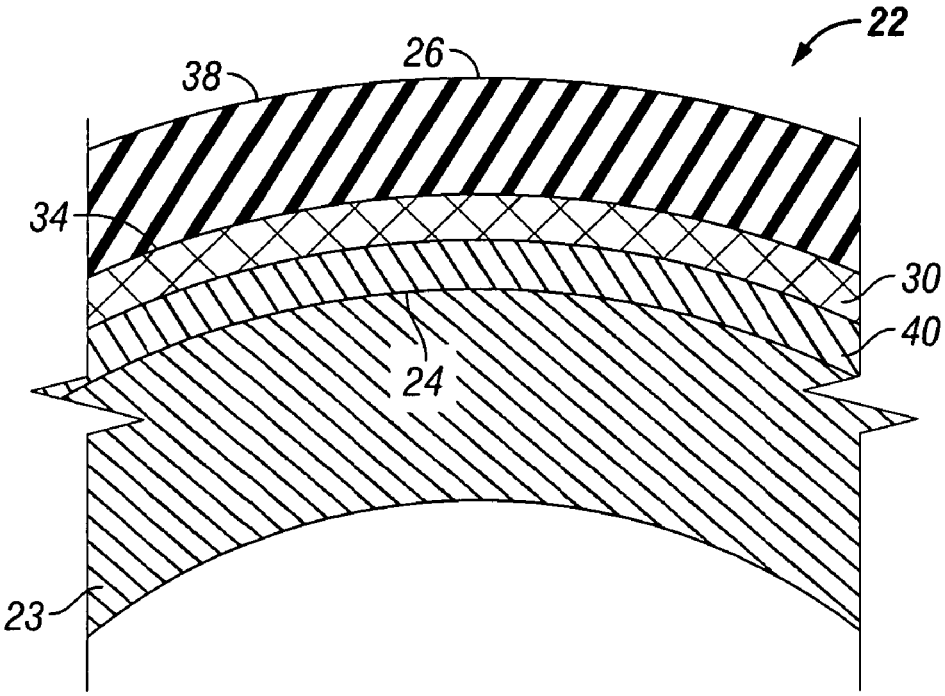
FIG. 7 is a partial cross-sectional top view of still another specific embodiment of a seal ring of the downhole tool of FIG. 1 showing a metal foam material disposed between a sealing material and an adhesion metal, the adhesion metal being disposed on a metal surface of the seal ring.

Referring now to FIG. 7, in yet another embodiment, metal foam material 30 is disposed on one or more adhesion metals 40 to facilitate bonding metal foam material 30 to metal surface 24 of reinforcing element 23 and sealing material 26 is disposed on metal foam material 30. Metal foam material 30 may be an opened-cell metal foam material (FIG. 2) or a closed-cell metal foam material (FIG. 3). In the embodiments in which metal foam material 30 is an opened-cell metal foam material (FIG. 2), sealing material 26 may be disposed within the interstitial spaces 31 (FIG. 2) provided by the opened-cell metal foam material (as discussed above with respect to the embodiments of FIGS. 4 and 6), as well as extending outwardly from metal foam material surface 34 to provide sealing material surface 38 (as shown in FIGS. 5 and 7). In the embodiments in which metal foam material 30 is a closed-cell metal foam material, sealing material 26 is disposed on the surface of metal foam material 30 (FIGS. 5 and 7), including within each pocket or crater 33 (FIG. 3) on the surface of metal foam material 30 so that during compression, sealing material 26 microscopically reduces extrusion gaps to form a tight seal.

In operation, a sealing device comprises a sealing element comprising a metal foam material. The sealing element is placed into contact with a sealing surface. The sealing element is compressed causing the metal foam material to collapse, or compress, into the pockets. As the metal foam material collapses or compresses, a seal is formed between the sealing element and the sealing surface.

In the embodiments in which a sealing material is included in one or more of the pockets of the metal foam material of the sealing element, the sealing material is at least partially extruded from the pocket or pockets containing the sealing material when the metal foam material is compressed or collapsed to facilitate creation of the seal between the sealing element and the sealing surface.

In one particular embodiment in which the sealing element is placed on a sealing device such as a packer, the sealing device is formed of a metal foam material disposed along an outer wall surface of the sealing device. The metal foam material includes a plurality of pockets. The sealing device is placed in a tool sting and lowered into a wellbore to a desired depth. The sealing device is then actuated, through any method or device known to persons in the art, and the metal foam material of the sealing element is compressed. During compression, metal portions of the metal foam material collapse or compress into the pockets. As a result of the compression of the metal foam material, a seal is created between the sealing element and a sealing surface such as an inner wall surface of casing disposed within the wellbore. Alternatively, or in addition, a sealing material may be included as part of the sealing element to assist or facilitate creation of the seal.

It is to be understood that the invention is not limited to the exact details of construction, operation, exact materials, or embodiments shown and described, as modifications and equivalents will be apparent to one skilled in the art. For example, the sealing element may be disposed on an expandable casing or as part of any other sealing device known to persons in the art. Moreover, the metal foam material may be formed into any shape desired or necessary to provide the necessary sealing of the wellbore. Additionally, the metal foam material may be coated with any material, whether another metal or an elastomeric or polymeric material, desired or necessary to provide the necessary sealing of the wellbore. Further, the sealing device is not required to be a packer or a packer as disclosed in FIGS. 1 and 4-7. The sealing device may be any other downhole tool that provides a seal between the downhole tool and an inner wall surface of a wellbore. The sealing device may also be part of any other downhole tool that provides compression to create a seal between two surfaces, regardless of whether the seal isolates a wellbore. Moreover, the sealing device may be included on any other device or tool in which a seal is desired. Thus, the sealing device is not limited to downhole tools. Further, the seal formed by the sealing elements do not have to be leak-proof. The seals only need to sufficiently create a seal so that the desired downhole operation, or completion method, can be run. Accordingly, the invention is therefore to be limited only by the scope of the appended claims.

What is claimed is:

1. A sealing device for use in a wellbore to isolate an annulus of the wellbore, the sealing device comprising:

a sealing element comprising a metal foam material disposed on a surface of the sealing device, the metal foam material comprising an initial position in which the metal foam material comprises a plurality of pockets each having an initial volume and a compressed position in which at least one of the initial volumes of at least one of the plurality of pockets is reduced by compression of the metal foam material, wherein the metal foam material isolates the annulus of the wellbore when the metal foam material is in the compressed position.

2. The sealing device of claim 1, wherein the metal foam material comprises an opened-cell arrangement and the plurality of pockets comprises at least one interstitial space.

3. The sealing device of claim 2, wherein at least one of the initial volumes of the plurality of pockets comprises a sealing material disposed therein.

4. The sealing device of claim 3, wherein the sealing material comprises a swellable material.

5. The sealing device of claim 2, wherein each of the initial volumes of the plurality of pockets comprises a sealing material disposed therein.

6. The sealing device of claim 2, wherein the sealing element further comprises a sealing material disposed on an outer wall surface of the metal foam material.

7. The sealing device of claim 2, wherein the surface of the sealing device is a metal surface and wherein the sealing element further comprises an adhesion metal disposed between the metal foam material and the metal surface.

8. The sealing device of claim 7, wherein the adhesion metal comprises a metal that has a lower melting point than a melting point of the metal foam material.

9. The sealing device of claim 1, wherein the metal foam material comprises aluminum.

10. The sealing device of claim 1, wherein the metal foam material comprises a closed-cell arrangement.

11. The sealing device of claim 10, wherein at least one of the initial volumes of the plurality of pockets comprises a sealing material disposed therein.

12. The sealing device of claim 11, wherein the sealing material comprises a swellable material.

13. The sealing device of claim 10, wherein the sealing element further comprises a sealing material disposed on an outer surface of the metal foam material.

14. The sealing device of claim 10, wherein the surface of the sealing device is a metal surface and wherein the sealing element further comprises an adhesion metal disposed between the metal foam material and the metal surface.

15. The sealing device of claim 14, wherein the adhesion metal comprises a metal that has a lower melting point than a melting point of the metal foam material.

16. The sealing device of claim 10, wherein the metal foam material comprises aluminum.

17. A method of forming a seal between a sealing device and a sealing surface, the method comprising the steps of:

(a) contacting a sealing device with a sealing surface, the sealing device comprising a metal foam material disposed on a surface of the sealing device, the metal foam material comprising an initial position in which the metal foam material comprises a plurality of pockets each having an initial volume and a compressed position in which at least one of the initial volumes of at least one of the plurality of pockets is reduced by compression of the metal foam material; and (b) compressing the metal foam material into the sealing surface causing the metal foam material to move from the initial position to the compressed position, causing a seal to be formed between the metal foam material and the sealing surface, the seal blocking fluid flow in between the metal foam material and the sealing surface.

18. The method of claim 17, wherein at least one of the plurality of pockets comprises a sealing material and wherein the sealing material is at least partially extruded from at least one of the at least one of the plurality of pockets during step (b).

19. The method of claim 17, wherein the metal foam material is an opened-cell metal foam material comprising a plurality of interstitial spaces, at least one of the interstitial spaces comprising a sealing material disposed therein, and the sealing material is at least partially extruded from at least one of the plurality of interstitial spaces during step (b).

20. A method of sealing a wellbore to divide an annulus of the wellbore, the method comprising:

(a) securing a downhole tool to a string of tubing, the downhole tool comprising a sealing device comprising a metal foam material, the metal foam material comprising an initial run-in position in which the metal foam material comprises a plurality of pockets each having an initial volume and a compressed position in which at least one of the initial volumes of at least one of the plurality of pockets is reduced by compression of the metal foam material;

(b) running the downhole tool in a wellbore;

(c) compressing the metal foam material from the initial run-in position to the compressed position, thereby sealing and dividing the annulus of wellbore with the metal foam material in the compressed position.

21. The method of claim 20, wherein at least one of the plurality of pockets comprises a sealing material and wherein the sealing material is at least partially extruded from the at least one of the at least one of the plurality of pockets during step (c).

22. The method of claim 20, wherein the metal foam material is an opened-cell metal foam material comprising a plurality of interstitial spaces, at least one of the interstitial spaces comprising a sealing material, and the sealing material is at least partially extruded from at least one of the plurality of interstitial spaces during step (c).

* * * * *